US006375191B1

(12) United States Patent
Heggie

(10) Patent No.: US 6,375,191 B1
(45) Date of Patent: Apr. 23, 2002

(54) SNOOKER TABLE

(75) Inventor: David W.M. Heggie, Randberg (ZA)

(73) Assignee: Alistair Spence Heggie, Vlisshingen (NL)

( * ) Notice: Subject to any disclaimer, the term of this patent is extended or adjusted under 35 U.S.C. 154(b) by 0 days.

(21) Appl. No.: 09/355,873

(22) PCT Filed: Feb. 5, 1998

(86) PCT No.: PCT/GB98/00366

§ 371 Date: Aug. 5, 1999

§ 102(e) Date: Aug. 5, 1999

(87) PCT Pub. No.: WO98/34692

PCT Pub. Date: Aug. 13, 1998

(30) Foreign Application Priority Data

Feb. 5, 1997 (ZA) ..... 970933

(51) Int. Cl.[7] ..... A63F 9/00
(52) U.S. Cl. ..... 273/309; 473/4
(58) Field of Search ..... 273/309; 473/1, 473/4, 14, 18, 20, 29, 31, 32

(56) References Cited

U.S. PATENT DOCUMENTS 3,544,108 A * 12/1970 Bali
4,004,804 A 1/1977 Gholson
4,948,128 A * 8/1990 Emery

FOREIGN PATENT DOCUMENTS

GB 131751 9/1919
GB 2 200 294 8/1988

* cited by examiner

*Primary Examiner*—Benjamin H. Layno
*Assistant Examiner*—Vishu K Mendiratta
(74) *Attorney, Agent, or Firm*—Venable; Gabor J. Kelemen; Catherine M. Voorhees

(57) ABSTRACT

The present invention relates to a snooker table (10) having a conventional rectangular outer frame opposed major sides (12, 14) and minor sides (16, 18). The playing surface (20) is non-rectangular, in that a pair of arrowhead or 'V' shaped projections (22, 24) extend inwardly from respective major sides (12, 14). The playing surface (20) thus has an hour glass-type shape, and is bounded by a conventional cushion (26). Pockets are provided at opposite corners of the table, as in conventional snooker table. The projections (22, 24) terminate in similar pockets (30A, 30B), which are located along the same center line as the middle pockets of a standard snooker table, but which are spaced inwardly relative thereto. The snooker table provides for a snooker type game which is both versatile and challenging.

4 Claims, 2 Drawing Sheets

SNOOKER TABLE

BACKGROUND OF THE INVENTION

This invention relates to a snooker table, as well as to apparatus for playing a snooker-type game.

Snooker, pool, billiards and other similar snooker-type games have been played in an unchanged form for many centuries.

SUMMARY OF THE INVENTION

It is an objection of the invention to provide a snooker-type game which is both versatile and challenging.

In a first respect the present invention provides a snooker table having a plurality of edges consisting essentially of a first pair of parallel spaced apart edges and a second pair of parallel spaced apart edges defining a playing surface therebetween, and a plurality of pockets, characterised in that at least one of said edges has at least one formation having at least one edge portion extending at an angle to the edge in which said formation is provided so as to define a non-rectangular playing surface.

Preferably, the formation comprises an inwardly extending projection having edges which are angled at a slant relative to the side edges of the table.

Conveniently, a pocket is located along the formation.

Advantageously, the playing surface has an hourglass-type shape, defining a pair of arrowhead shaped projections which terminate in pockets.

According to another aspect of the invention there is provided a snooker table having at least one irregular formation defining a non-rectangular playing surface.

The invention extends to apparatus for playing a snooker-type game comprising a table of the type described and at least two sets of differently colored balls, each set comprising at least three balls.

BRIEF DESCRIPTION OF THE DRAWINGS

Further preferred features and advantages of the present invention will appear from the following detailed description given by way of example of some preferred embodiments illustrated with reference to the accompanying drawings in which.

DETAILED DESCRIPTION OF THE INVENTION

Figure 1:
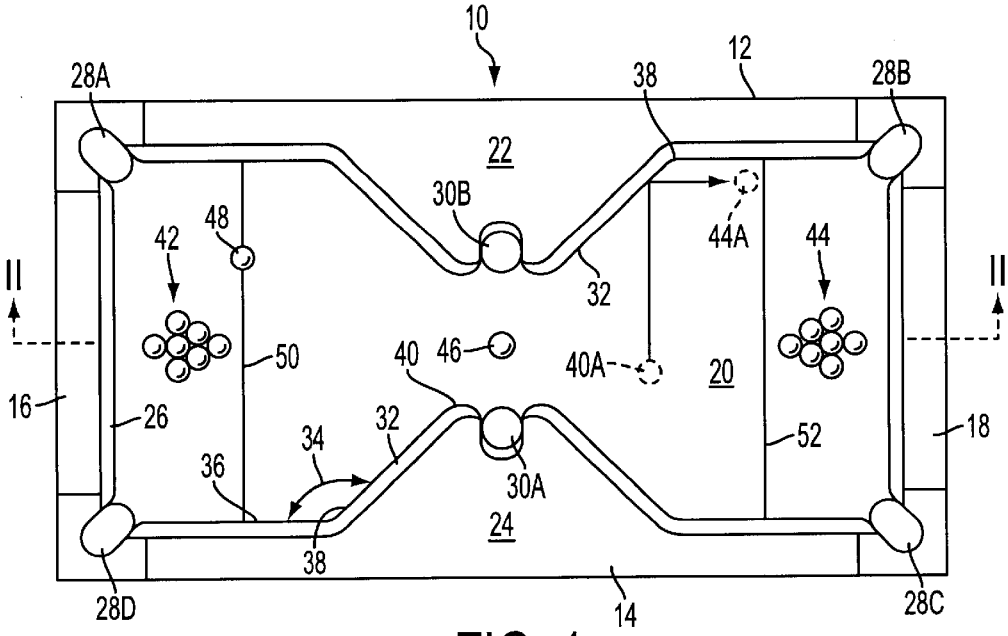
FIG. 1 is a top plan view of a first embodiment of a snooker table of the invention.

Referring to FIG. 1, a snooker table 10 has a conventional rectangular outer frame having opposed major sides 12 and 14 and minor sides 16 and 18. The playing surface 20 is non-rectangular, in that a pair of arrow-shaped projections 22 and 24 extend inwardly from respective major sides 12 and 14. The playing surface 20 thus has an hour glass-type shape, and is bounded by conventional cushion 26. Pockets 28 are provided at opposite corners of the table, as in a conventional snooker table. The projections 22 and 24 terminate in similar pockets 30A and 30B, which are located along the same center line as the middle pockets of a standard snooker table, but which are spaced inwardly relative thereto.

Each projection 22 and 24 has flank edges 32 which form an angle 34 of approximately 135° relative to the side edges 36 of the table. A relatively sharp corner 38 is defined between each side edge 36 and each flank edge 32. The flank edge 32 terminates in a curved portion 40 which curves towards its middle pocket 30A.

Apart from the snooker table 10, the apparatus for playing the snooker-type game also includes a set of seven red balls 42, a set of seven yellow balls 44, a black ball 46 and a white cue ball 48.

Prior to commencement of play, the red and yellow sets of balls 42 and 44 are arranged as shown in FIG. 1, (or according to the modified arrangement shown in FIG. 6 and described below) with the front ball being located behind marker lines 50 and 52, which are parallel to the sides 16 and 18, and are located approximately one sixth of the way along the surface of the table 20. The black ball 46 is located at the center of the playing surface 20, and the white cue ball 48 may be positioned anywhere along one of the marker lines 50 or 52 to start off or to restart play.

Each player is allocated the yellow or the red set of balls, and it is an object of the game to sink all the balls of a particular color, such as the yellow balls 44, followed by the black ball 46. Various penalties are applied if the black ball, the white ball or a ball belonging to another player is sunk inadvertently.

As a result of the angled flank edges 32, far greater versatility is provided than in a conventional snooker table. For instance, the flank edges 32 may be used to cause the balls to ricochet at unusual angels. By virtue of the projections 22 and 24, it is possible to snooker an opponent with only two balls remaining on the table. The angled flank edges 32 may also be used to the advantage of a player, for instance, if a player wishes to sink a ball 44A by using the white ball 40A, he merely aims the white ball at that portion of the flank edge 32 adjacent the corner 38, thereby resulting in the white ball ricocheting at the correct angle to sink the ball 44 in the pocket 28B. It will be appreciated that there are countless other possible variations in sinking balls or snookering an opponent.

Figure 3:
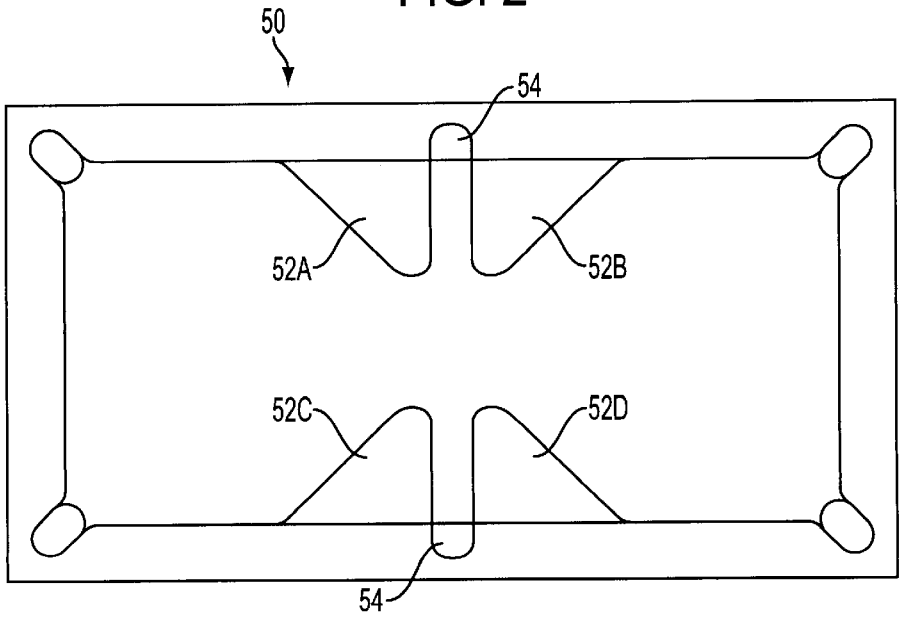
FIGS. 3–6 show schematic top plan views of four further embodiments of snooker tables of the invention.
Figure 4:
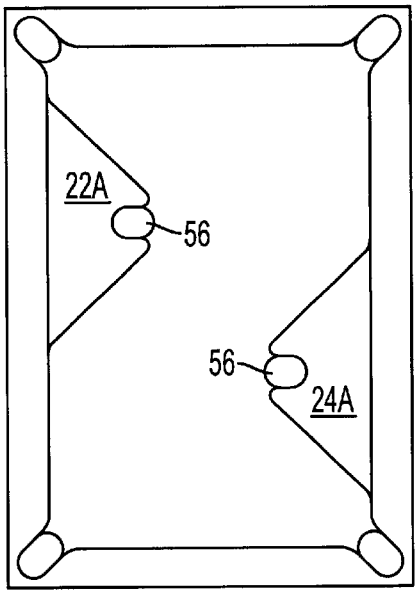
Figure 5:
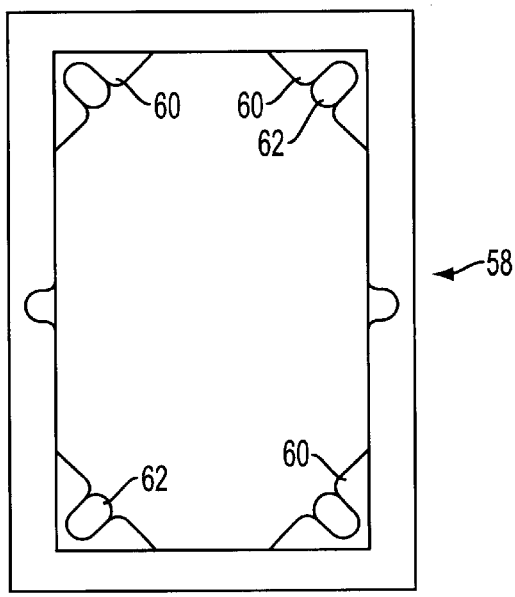

Turning now to FIG. 3, an alternative embodiment is shown in which a conventional snooker table 50 is adapted by clamping right-angled triangular projections 52A, 52B, 52C and 52B adjacent the centre pockets 54. In FIG. 4 a further embodiment is shown in which projections 22A and 24A, which are similar to those in FIG. 1, are displaced laterally relative to one another, together with their associated pockets 56. In FIG. 5, a still further embodiment of a snooker table 58 is shown having angled corner projections 60, with the corner pockets 62 displaced inwardly.

Figure 2:
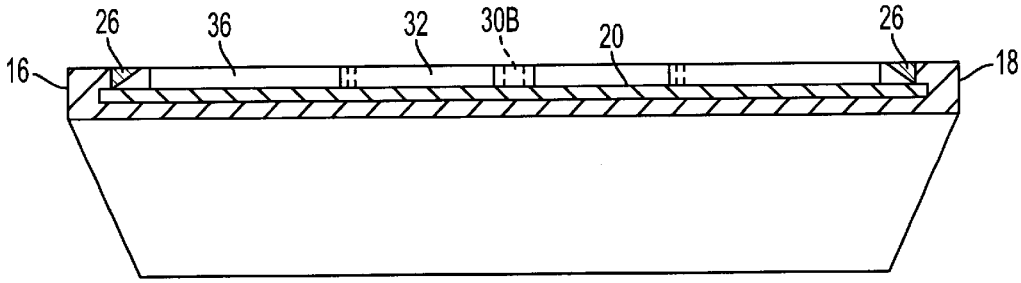
FIG. 2 is a cross-section on the line II—II of FIG. 1.
Figure 6:
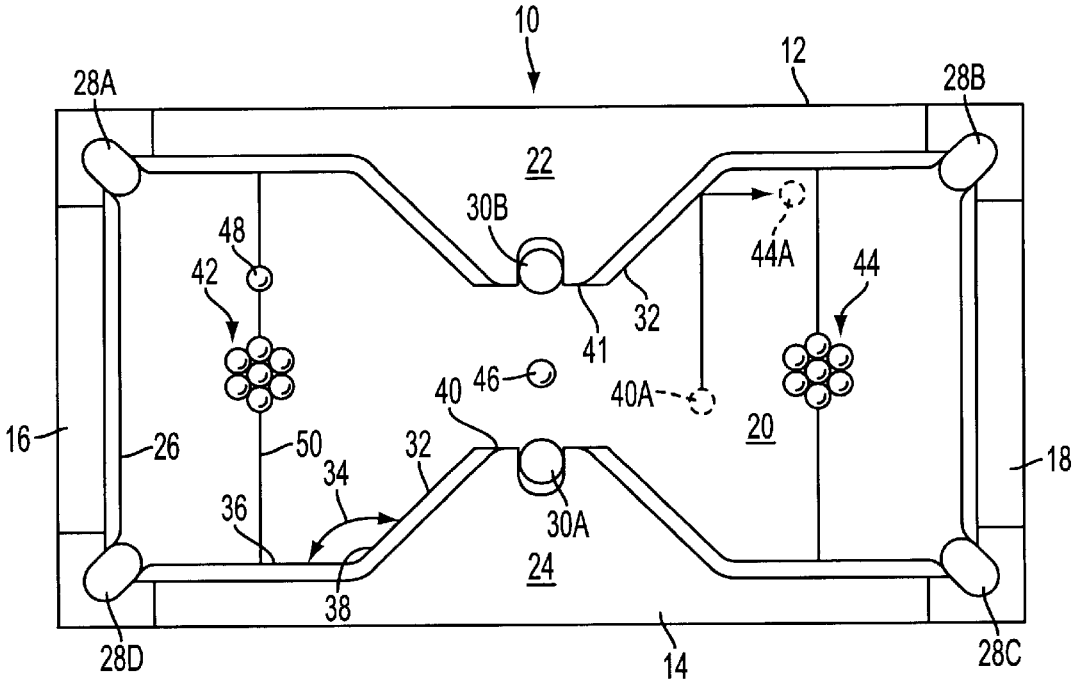

FIG. 6 is a further embodiment of snooker table according to invention and is generally similar to that shown in FIGS. 1 and 2 except that the curved portion 40 of the projection has a flattened nose portion 41 in which a pocket 30A, 30B is located. As will be seen also from FIG. 6 the set up of each player's balls is in a circular arrangement as distinct from the triangular arrangement shown in FIG. 1.

In one version of the game, the player who opens the break has to pocket at least one of the set of object balls (for example, the yellow balls) which he has been allocated.

Alternatively he has to allow at least two of the yellow balls to hit the cushion. Failure to do so is a foul break, which will result in the opposing player starting off the game with two shots. Should the opening player legally pocket one of his yellow balls, he may continue playing, provided he continues sinking balls without fouling. If one of the players breaks the red or yellow set of balls and only black ball drops into one of the pockets, then he is deemed to have won the game. However, if one of the colored balls is sunk simultaneously with the black ball, the opponent wins the game.

Fouls include an in-off of the cue ball into one of the pockets, failing to hit a ball with the cue ball, and hitting an opponent's ball before an own ball is struck. A foul is also committed if a jump shot is played, in which the cue ball jumps over any part of any ball before making contact with an object ball. If a player hits a black ball prior to hitting his object balls, a foul also occurs. In a stricter version of this game, the following events also constitute fouls.

A player's clothing or body touching any ball;

A player not having at least one foot on the floor;

A player touching with the cue any ball other than the cue ball;

Playing out of turn;

Playing before the balls have come to a rest;

Playing before the balls have been re-spotted;

Striking the cue ball with any part of the cue other than the tip;

Striking the cue ball with a cue more than once; and

Using the cue to line up the cue ball.

After the offending player has committed any one of the above fouls, he loses his next turn and his opponent is entitled to two consecutive shots. On the first of these penalty shots, the player may without nomination play the cue ball to any ball without penalty, including his opponent's object balls and the black ball. If he pots any balls directly or by combination, he is deemed to have played an illegal shot. However, he may not pot the black ball, which would mean losing the game, unless he has no object balls left.

If a player is snookered or is unable to play a legal full ball shot at any one of his own group of object balls after a foul stroke has been committed, then the cue ball may be played from his line. Moving the cue ball in this manner does not count as a shot. A full ball shot is defined as being able to strike the center of the object ball directly with the center of the cue ball. A player who clearly fails to attempt to play one of his own object balls loses the game.

A push stroke is allowed, but a player may play away from a touching ball which touches one of his object balls, and be deemed to have played that ball. Should the cue ball be touching an opponent's ball or black ball, the player is allowed to play away without penalty, providing that the cue ball strikes one of his own object balls. When a player has the cue ball in hand, he may play from any position on the starting line.

A player is said to be in control of the table from the time that his body, cue or clothing touches the table prior to his shot, up until his opponent does likewise prior to his shot. Any balls which fall into the pockets during this period, including the black ball, are regarded as having been potted by the player, and he is liable for any resultant penalties or awards.

The game is completed when the black ball is potted in any pocket and the remaining balls have come to rest.

If a player has to play the black ball, and it is covered with one or more of his opponent's balls, then he has one chance of trying to pot the black ball, or the game belongs to his opponent. If the player is on the black ball, and one of the opponent's balls is covering the black ball, the player is permitted two shots, which enable the player to play off his opponent's ball to pot the black ball only. No other colored ball may be sunk with the black ball.

There are countless other shapes and sizes of projections or even recesses that may be formed in a snooker table to provide it with a non-rectangular playing surface. Likewise, games involving different numbers and sets of balls may also be played on one of the snooker tables of the invention.

What is claimed is:

1. A snooker table having a plurality of edges consisting essentially of a first major part of parallel spaced apart edges and a second minor pair of spaced apart edges defining a playing surface therebetween, and a plurality of pockets, said playing surface having an hourglass-type shape defining a pair of arrow head or "V-shaped" projections which terminate in a pocket, said arrow head or "V-shaped" projections extending inwardly from a medial portion of each said edge of said major pair of spaced apart edges, characterized in that said first and second pairs of parallel spaced apart edges intersect to form four right angled corners, each of said corners being provided with a said pocket wherein each said arrow head or "V-shaped" projection terminates in a pocket having a generally flattened nose portion on either side thereof and said generally flattened nose portion extends a flat distance approximately equal to half the diameter of the "V-shaped" projection pocket and has two curved portions, one on either side of a side "V-shaped" projection pocket, said curved portions curving towards said "V-shaped" projection pocket from a flank edge of the "V-shaped" projection.

2. A snooker table having a plurality of edges consisting essentially of a major pair of parallel spaced apart edges and a second minor pair of spaced apart edges defining a playing surface therebetween, and a plurality of pockets, said playing surface having an hourglass-type shape defining a pair of arrow head or "V-shaped" projections which terminate in a pocket, said arrow head or "V-shaped" projections extending inwardly from a medial portion of each said edge of said major pair of spaced apart edges, substantially all of said "V-shaped" projection pocket being recessed in the "V-shaped" projection wherein a continuous convex curved portion extends on either side of the recessed pocket from the recessed pocket to a flank edge of the projection and said first and second pairs of parallel spaced apart edges intersect to form four right angled corners, each of said corners being provided with a said pocket thereby rendering the game more challenging while substantially maintaining the playability of the game.

3. A snooker table as claimed in claim 2 wherein the angle between the side edge of the table and the edge of the arrow or v-shaped projection is 135 degrees.

4. Apparatus for playing a snooker type game comprising a table according to claim 2 and at least two sets of differently colored balls, each set comprising at least three balls.

* * * * *